US007766765B2

(12) United States Patent
Oyama

(10) Patent No.: US 7,766,765 B2
(45) Date of Patent: Aug. 3, 2010

(54) WOOD-TYPE GOLF CLUB HEAD

(75) Inventor: Hitoshi Oyama, Kobe (JP)

(73) Assignee: SRI Sports Limited, Kobe-Shi (JP)

( * ) Notice: Subject to any disclaimer, the term of this patent is extended or adjusted under 35 U.S.C. 154(b) by 0 days.

(21) Appl. No.: 11/408,959

(22) Filed: Apr. 24, 2006

(65) Prior Publication Data

US 2006/0258481 A1 Nov. 16, 2006

(30) Foreign Application Priority Data

May 13, 2005 (JP) ..... 2005-141523

(51) Int. Cl.
*A63B 53/04* (2006.01)

(52) U.S. Cl. ..... 473/345; 473/349

(58) Field of Classification Search ..... 473/324–350
See application file for complete search history.

(56) References Cited

U.S. PATENT DOCUMENTS

| | | | | |
|---|---|---|---|---|
| 6,354,962 | B1 * | 3/2002 | Galloway et al. | 473/342 |
| 6,402,639 | B1 * | 6/2002 | Iwata et al. | 473/330 |
| 6,471,604 | B2 * | 10/2002 | Hocknell et al. | 473/334 |
| 6,875,129 | B2 * | 4/2005 | Erickson et al. | 473/345 |
| 7,318,781 | B2 * | 1/2008 | Deshmukh | 473/342 |

FOREIGN PATENT DOCUMENTS

| | | | |
|---|---|---|---|
| JP | 8-126723 | A | 5/1996 |
| JP | 2001-37924 | A | 2/2001 |
| JP | 2004188190 | A * | 7/2004 |

* cited by examiner

*Primary Examiner*—Alvin A Hunter
(74) *Attorney, Agent, or Firm*—Birch, Stewart, Kolasch & Birch, LLP

(57) ABSTRACT

A wood-type golf club head has a volume V (cc) of not less than 350 cc and a club face area S (sq.cm) of not less than 30 sq.cm but not more than V×0.08+5. Preferably, the weight of the face portion is in a range of from 20 to 40% of the overall weight of the club head, and the overall weight is in a range of from 150 to 210 grams.

8 Claims, 7 Drawing Sheets

WOOD-TYPE GOLF CLUB HEAD

BACKGROUND OF THE INVENTION

The present invention relates to a wood-type golf club head.

Recent years, wood-type golf clubs are increased in the head volume, and a hollow club head having a head volume over 350 cc is not yet uncommon.

In designing such large-sized heads, heretofore, as the head volume increases, the area of the club face is also increased almost in proportion thereto. And although the head volume is increased, the head is maintained at the almost same weight not to alter swing balance. Accordingly, the material thickness is decreased excepting the face portion because the face portion is required to have a sufficient strength and durability against impact. In other words, according to general design concepts until now, as the head volume increases, the head increases wholly including the club face.

When the area of the club face is increased, the deflection of the face portion at impact tends to increase, and accordingly, in order to provide the face portion with durability, it becomes necessary for the face portion to keep a relatively large thickness. As a result, in order to maintain the overall head weight, the portion other than the face portion has to be decreased in the thickness, and the durability is deteriorated.

Further, in view of the weight distribution design, it becomes difficult to control the position of the center of gravity of the head because the weight margin available for adjusting the distribution is reduced.

SUMMARY OF THE INVENTION

It is therefore, an object of the present invention to provide a wood-type golf club head, in which, although a large head volume, the weight margin can be increased without deteriorating the durability and other performance.

According to the present invention a wood-type golf club head has a head volume V (cc) of not less than 350 cc and comprises a face portion of which front surface defines a club face for hitting a ball, wherein the area S (sq.cm) of the club face is not less than 30 sq.cm and not more than $V \times 0.08+5$. Preferably, the weight of the face portion is in a range of from 20 to 40% of the overall weight of the club head. The overall weight is preferably in a range of from 150 to 210 grams.

Therefore, the area of the club face is limited to smaller values in relation to the head volume when compared with the usual large-sized heads. As a result, the face portion can be provided with a sufficient durability without increasing the thickness, whereby the increase in the weight of the face portion can be avoided and a large weight margin is available.

BRIEF DESCRIPTION OF THE DRAWINGS

FIGS. 8 and 9 show an example of the head provided in the crown portion with a forwardly curvature increasing zone, wherein FIG. 8 is the front view and FIG. 9 is a cross sectional view taken along line B-B of FIG. 8, including the sweet spot and center of gravity.

FIGS. 10 and 11 show an example of the head provided in the sole portion with a forwardly curvature increased zone, wherein FIG. 10 is the front view and FIG. 11 is a cross sectional view taken along line C-C of FIG. 10, including the sweet spot and center of gravity.

DESCRIPTION OF THE PREFERRED EMBODIMENTS

Figure 1:
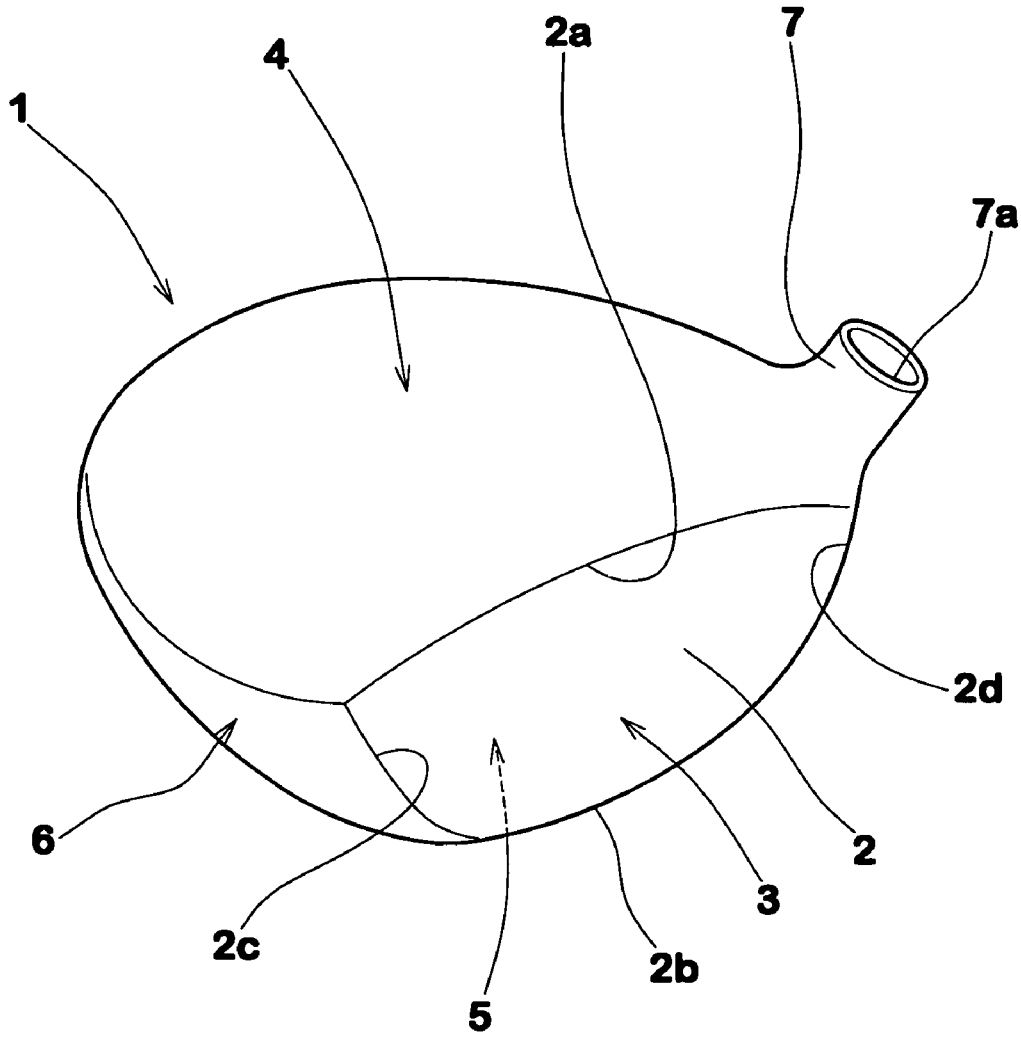
FIG. 1 is a perspective view of a wood-type golf club head according to the present invention.

Embodiments of the present invention will now be described in detail in conjunction with the accompanying drawings.

In the drawings, wood-type hollow golf club head 1 according to the present invention comprises: a face portion 3 whose front face defines a club face 2 for hitting a ball; a crown portion 4 intersecting the club face 2 at the upper edge 2*a* thereof; a sole portion 5 intersecting the club face 2 at the lower edge 2*b* thereof; a side portion 6 between the crown portion 4 and sole portion 5 which extends from a toe-side edge 2*c* to a heel-side edge 2*d* of the club face 2 through the back face of the club head; and a hosel portion 7 protruding upward from the crown portion 4 and provided at the upper end thereof with a shaft inserting hole 7*a* to be attached to an end of a club shaft (not shown).

Figure 2:
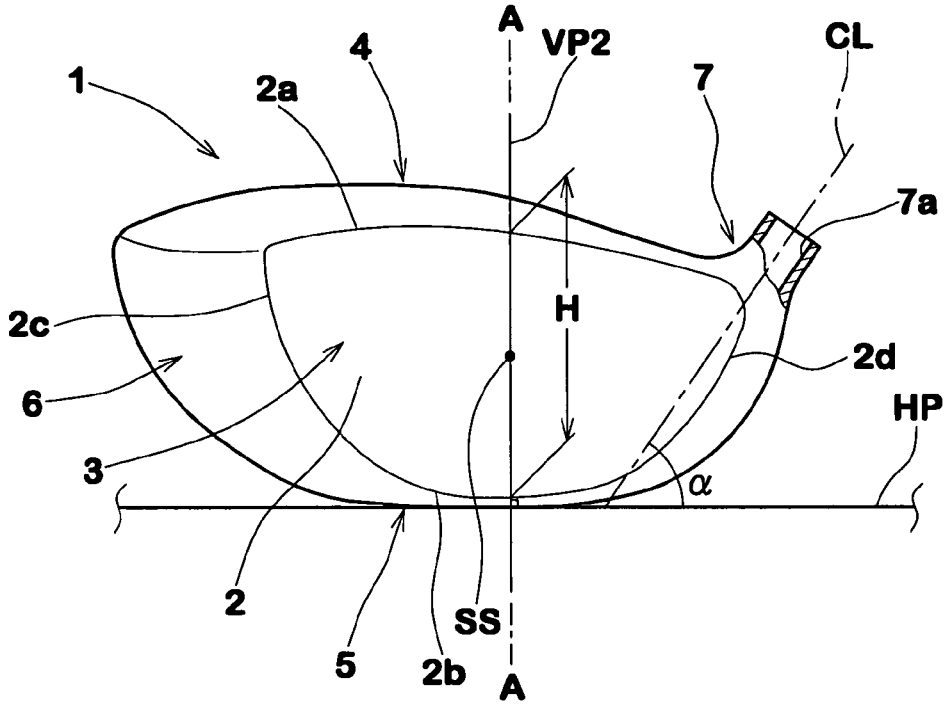
FIG. 2 is a front view thereof.
Figure 3:
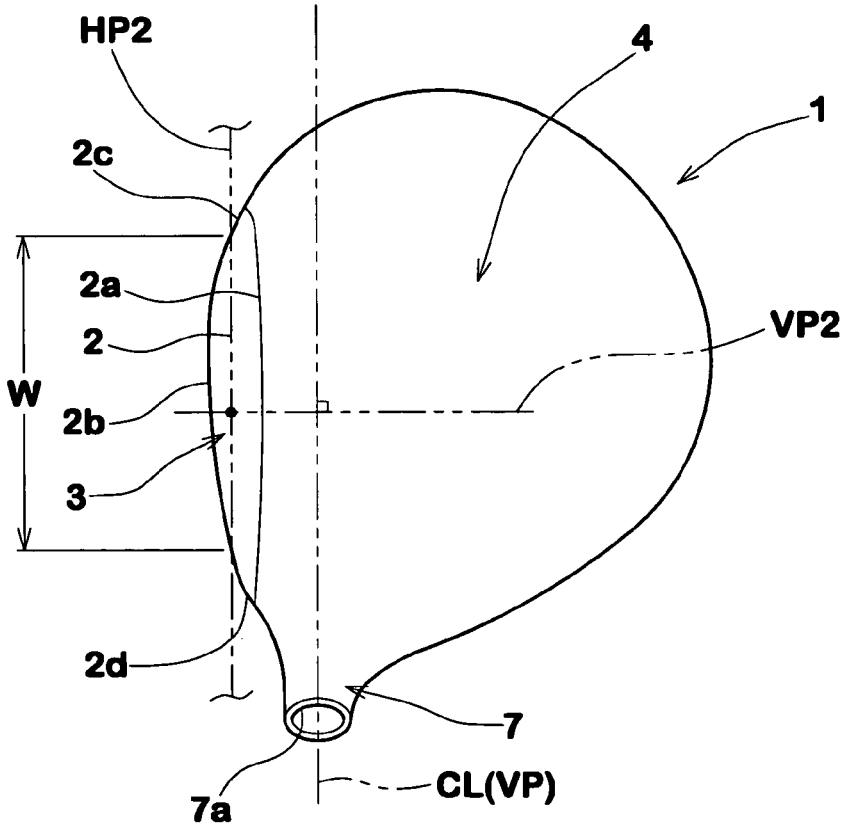
FIG. 3 is a top view thereof.
Figure 4:
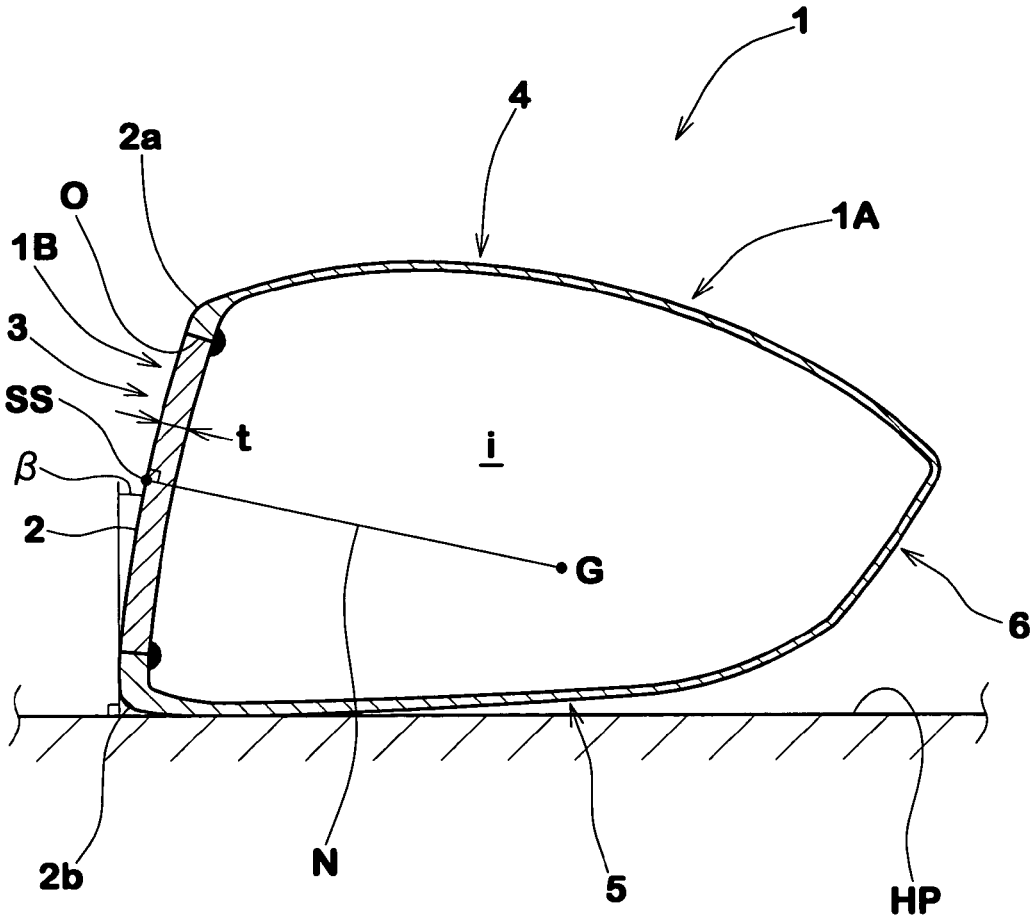
FIG. 4 is a cross sectional view taken along line A-A of FIG. 2.

Here, the standard state is defined such that, as shown in FIGS. 2, 3 and 4, the golf club head is placed on a horizontal plane HP so that the center line CL of the club shaft or shaft inserting hole 7*a* is inclined at the lie angle alpha while keeping the center line CL on a vertical plane VP, and the club face 2 forms its loft angle beta with respect to the vertical plane VP.

The club head 1 is made of one or more metal materials, e.g. aluminum alloy, pure titanium, titanium alloy, stainless steel, maraging steel and the like. But, it is also possible to use, in combination with such metal material(s), a further material having a relatively low specific gravity, e.g. magnesium alloy, fiber reinforced resin and the like.

In this embodiment, the club head 1 is composed of a face plate 1B, and a head main body 1A provided at the front with an opening O in which the face plate 1B is fitted. The face plate 1B and head main body 1A are each made of a metal material and welded each other. Aside from such two-piece structure, it is also possible to employ a three- or four- or more piece structure wherein each piece or part is formed by casting, forging, pressing, rolling or the like. In other words, the head main body 1A can be a single-piece part or a two- or more piece part.

As the present invention is intended to provide a large-sized head which is improved in the durability and increased in the degree of freedom of the weight distribution design, the head volume V of the club head is set in a range of not less than 350 cc, but the upper limit is 460 cc when complying the regulations of USGA and R&A. Thus, the present invention is preferably applied to the club heads having a head volume V of more than 360 cc, more preferably more than 400 cc, but less than 500 cc. The head volume V is an apparent volume including the volume of the shaft inserting hole 7*a*, the hollow (i) and the like.

According to the present invention, the area S of the club face 2 (hereinafter the "club face area") is decreased. But, in view of the variation of the ball hit positions on the club face, especially wide variations of amateur golfers, and the player's feeling in address position, the club face area S is at least 30 sq.cm, preferably more than 31 sq.cm, more preferably more than 33 sq.cm.

Here, the club face area S is the area defined by the edge E of the club face 2 consisting of the upper edge 2*a*, lower edge 2*b*, toe-side edge 2*c* and heel-side edge 2*d*, and measured, excluding dents and protrusions such as face grooves, punch mark and the like.

Figure 5:
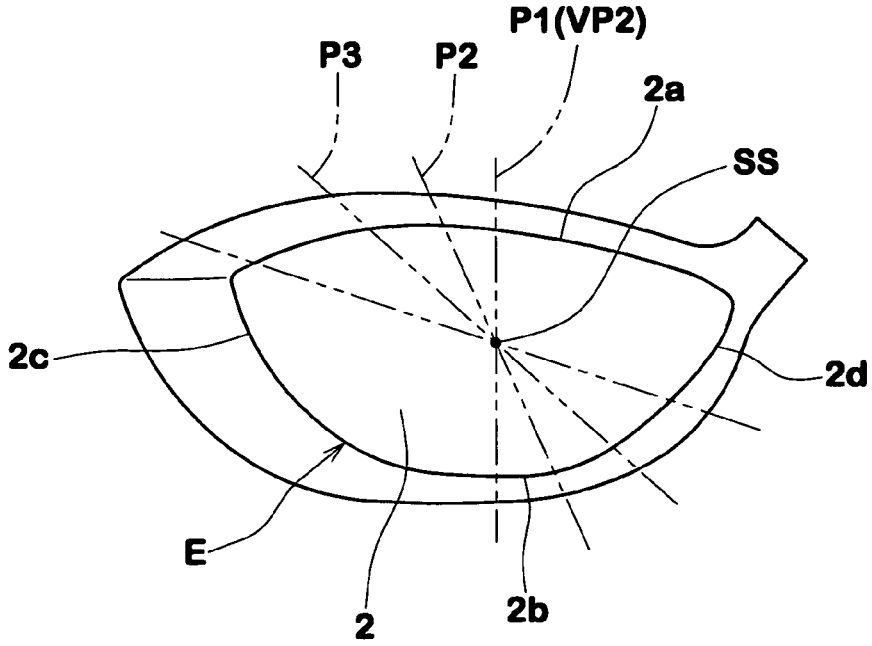
FIGS. 5 and 6 are a schematic front view and cross sectional view for explaining the definition of the edge of the club face and the definition of the face portion.
Figure 6:
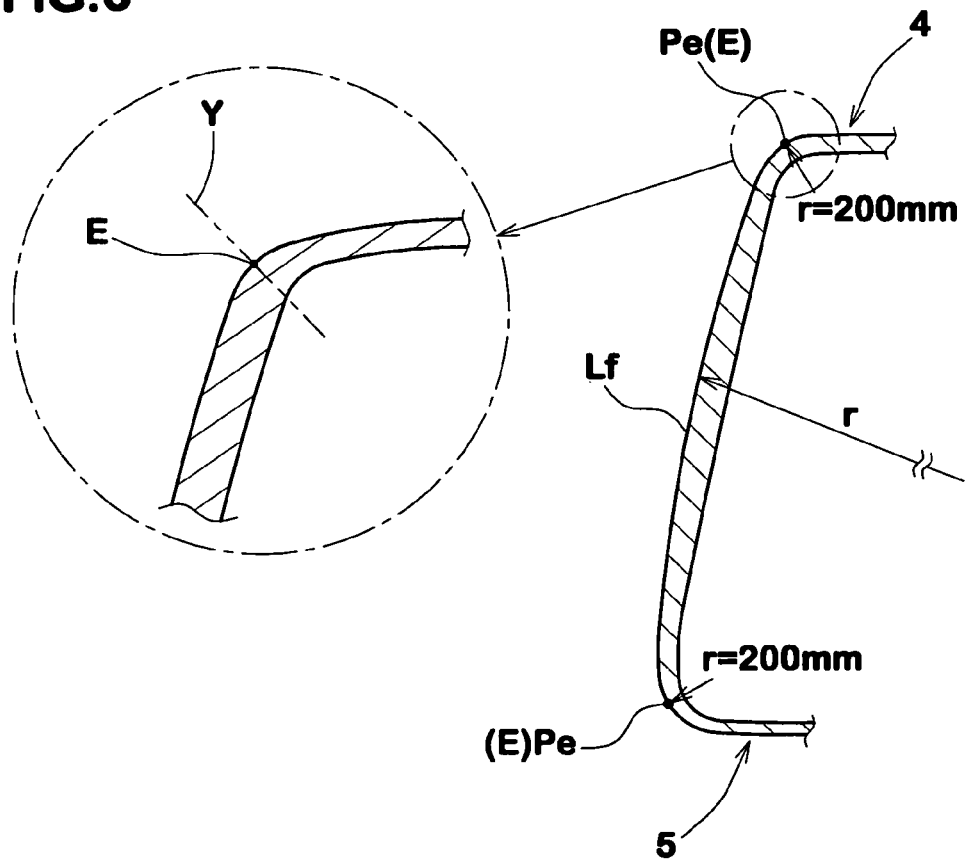

If the edge E is unclear due to smooth change in the curvature, a virtual edge line (Pe) which is defined, based on the curvature change is used instead as follows. As shown in FIG. 5, in each cutting plane P1, P2 - - - including a straight line N extending between the sweet spot SS of the club face 2 and the center of gravity G of the head, as shown in FIG. 6, a point Pe at which the radius (r) of curvature of the profile line Lf of the face portion first becomes under 200 mm in the course from the center SS to the periphery of the club face is determined. Then, the virtual edge line is defined as a locus of the points Pe.

In view of the rebound characteristic, it is preferable that the height H of the club face 2 is set in a range of not less than 35 mm, preferably more than 38 mm, more preferably more than 40 mm, but in view of the primary object of the invention, not more than 60 mm, preferably less than 57 mm, more preferably less than 55 mm.

Here, the height H is, as shown in FIG. 2, the vertical height measured from the upper edge 2*a* to the lower edge 2*b* in a second vertical plane VP2 which includes the sweet spot SS and is orthogonal with the above-mentioned vertical plane VP, under the above-mentioned standard state.

Further, the width W of the club face 2 is set in a range of not more than 110 mm, preferably less than 105 mm in view of the primary object, but not less than 70 mm, preferably more than 75 mm, more preferably more than 80 mm to reduce miss shots. The width W is, as shown in FIG. 3, the horizontal width measured from the toe-side edge 2*c* to heel-side edge 2*d* in a second horizontal plane HP2 which includes the sweet spot SS and is parallel with the horizontal plane HP.

According to the present invention, the club face area S (sq.cm), and the head volume V(cc) are determined to satisfy the following condition (1), preferably (2), more preferably (3):

$$S \leqq 0.08 \times V + 5 \quad (1)$$

$$S \leqq 0.08 \times V + 4 \quad (2)$$

$$S \leqq 0.08 \times V + 2 \quad (3)$$

However, if the numeric value (S−0.08×V) becomes too small, as the club face area S becomes small for the head volume V, miss shots tends to increase. Therefore, it is desirable that the following condition (4) is satisfied.

$$0.08 \times V - 6 \leqq S \quad (4)$$

By the above-mentioned conditional expression (1), (2) or (3), the maximum value of the club face area S is limited in relation to the volume V. This is however, not always meant to vary the club face area S in proportion to the head volume in designing the head. For example, in a specific range of the head volume, the club face area S may be set at almost constant values or within a very narrow range as far as the above-mentioned conditions are satisfied.

At any rate, the numerical value of the club face area S may be set in a range of not more than 45 sq.cm, more preferably less than 43 sq.cm, still more preferably less than 40 sq.cm.

Preferably, the weight of the face portion 3 (hereinafter the "face portion weight") is set in a range of not less than 20%, more preferably more than 22%, still more preferably more than 24%, but not more than 40%, more preferably less than 35%, still more preferably less than 30%, yet still more preferably less than 28% of the overall weight of the club head. Here, to determine the weight of the face portion 3, the face portion 3 is defined as a volume which is as shown in FIG. 6 encircled by the border line Y. The border line Y is perpendicular to a tangent to the club surface at the above-mentioned club face edge E in the cutting planes P1, P2 - - - .

If the face portion weight is less than 20% of the overall weight, it becomes difficult to provide a club face area of more than 30 sq.cm, while maintaining the required durability at the same time. If more than 40%, it becomes necessary to decrease the thickness in the portions other than the face portion 3 and as a result, the durability is liable to decrease.

If the club head is too light, the rebound characteristic of the head tends to decrease and there is a tendency for the golfers to feel something wrong during swing. If the club head is too heavy, the directional stability tends to deteriorate and the traveling distance of the ball tends to decrease. Therefore, the overall weight of the club head is preferably set in a range of not less than 150 grams, more preferably more than 170 grams, still more preferably more than 190 grams, but not more than 220 grams, more preferably less than 215 grams, still more preferably less than 210 grams.

If the thickness of the face portion 3 is too large, as the weight of the face portion 3 increases, there is a tendency that the weight margin decreases and the rebound characteristic of the face deteriorates. If the thickness is too small, it is difficult to provide a sufficient durability. Therefore, the average thickness (t) of the face portion 3 is preferably set in a range of not less than 1.0 mm, more preferably more than 1.5 mm, still more preferably more than 2.5 mm, but not more than 4.0 mm, more preferably less than 3.5 mm, still more preferably less than 3.0 mm. Here, the average thickness means the area weighted average thickness. Given that the objective part is made up of small regions i (i=1, 2 - - - n) each having a thickness ti and area Si, the average thickness is $\Sigma(ti \times Si)/\Sigma S$ (i=1, 2 - - - n) Thus, the average thickness may be regarded as the volume of the objective part divided by the total area ($S=\Sigma Si$).

When the face portion 3 has a variable thickness, the minimum thickness is not less than 1.05 mm, preferably more than 1.5 mm, more preferably more than 1.8 mm, still more preferably more than 2.0 mm, yet still more preferably more than 2.5 mm.

If the ratio (t/S) of the average thickness (t) to the club face area S is decreased, the face portion 3 tends to decrease in the durability. If the ratio (t/S) is too large, the rebound characteristic is deteriorated to decrease the traveling distance of the ball. Therefore, the ratio t(cm)/S(sq.cm) is set in a range of not less than 0.060, preferably more than 0.065, more preferably more than 0.068, but not more than 0.150, preferably less than 0.100, more preferably less than 0.090.

Figure 7:
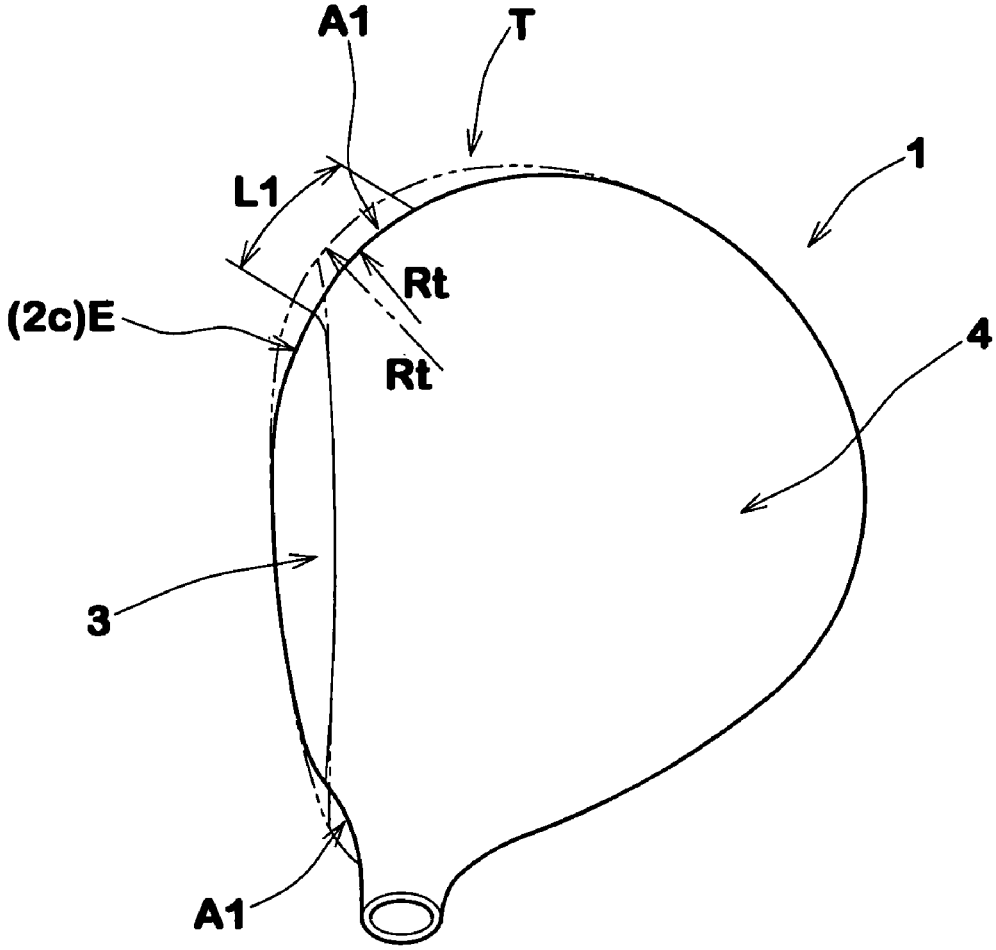
FIG. 7 is a top view showing an example provided in the side portion with a forwardly curvature increased zone.
Figure 8:
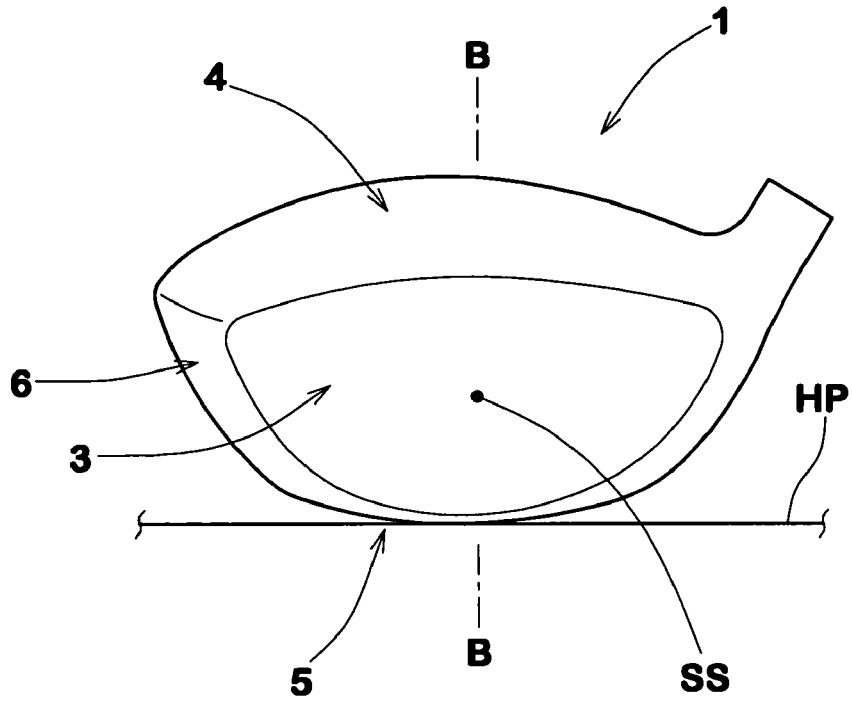
Figure 9:
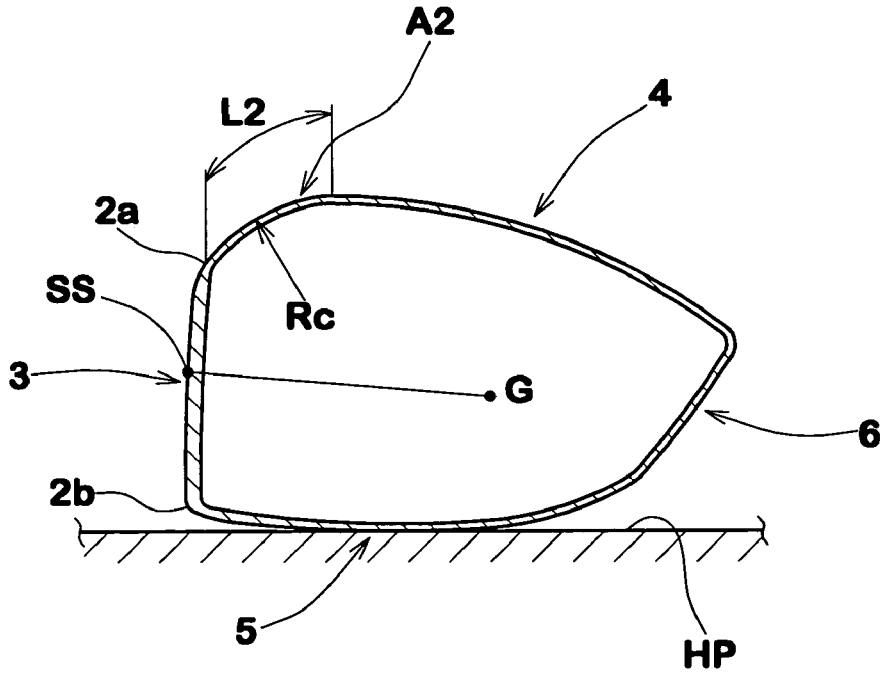
Figure 10:
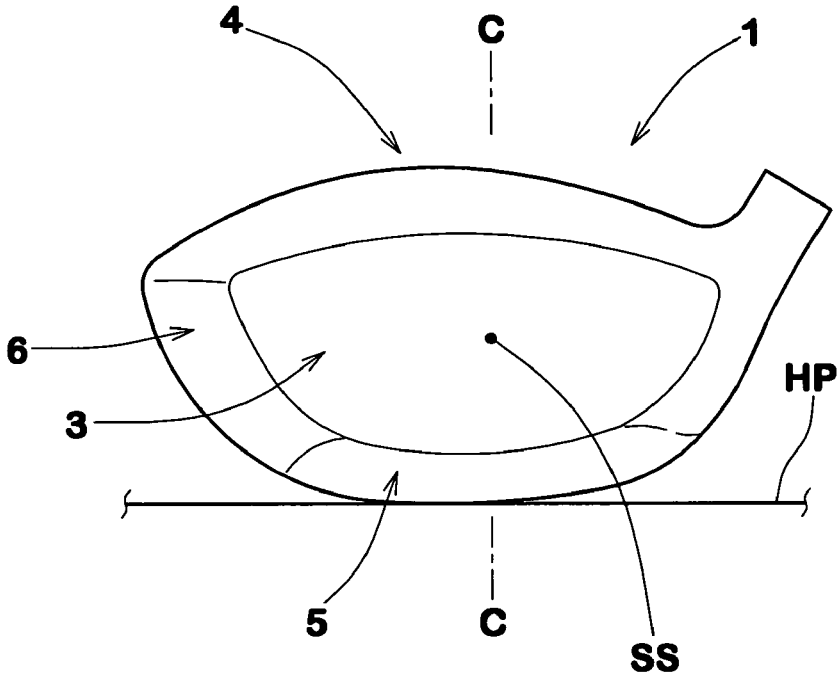
Figure 11:
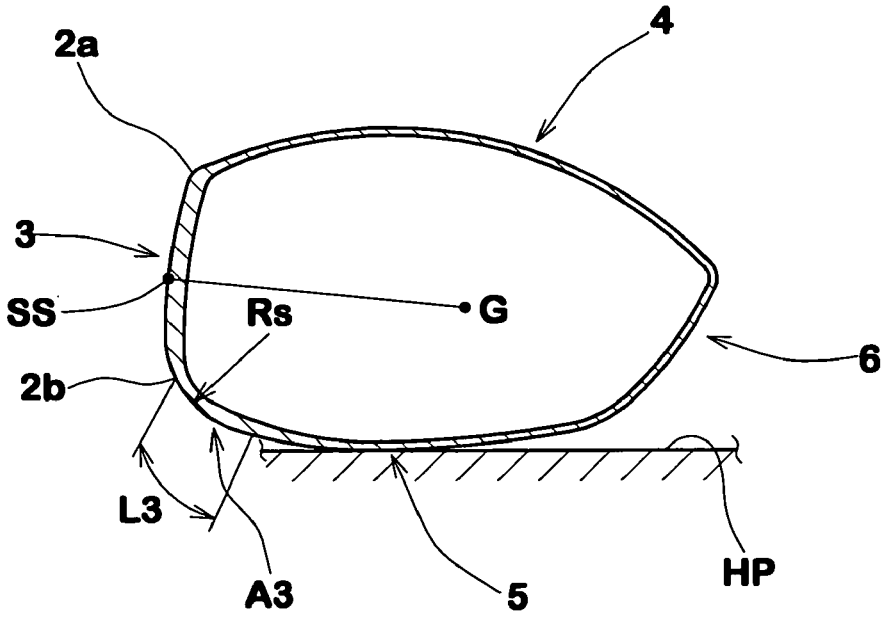

To decrease or adjust the club face area S, the curvature of the outer surface of the head can be increased (namely, the radius (Rt, Rc, Rs) of curvature can be decreased) in a specific zone (L1, L2, L3) which is defined as extending backward from the above-mentioned club face edge E. In such zone (L1, L2, L3), the outer surface is curved so as to smoothly merge into the club face 2. For this purpose, the radius (Rt, Rc, Rs) of curvature is progressively decreased towards the club face 2. In the front-and-back direction, the zone (L1, L2, L3) extends backwards from the edge E for 30 to 60 mm. Such a zone can be provided in at least one of the crown portion 4, sole portion 5 and side portion 6 as shown in FIGS. 7-11. FIG. 7 shows an example wherein the zone L1 is provided in the side portion 6. FIGS. 8 and 9 show an example wherein the head 1 is provided in the crown portion with the zone L2. FIGS. 10 and 11 show an example wherein the head 1 is provided in the sole portion with the zone L3.

In the example shown in FIG. 7, in the top view of the club head 1 in the standard state, with respect to the contour of the head, the length of the zone L1 is 30 to 60 mm along the outer surface of the toe front region A1, and the radius Rt of curvature of the outer surface is not less than 3 mm, preferably more than 5 mm, but not more than 60 mm, preferably less than 50 mm. The radius Rt is progressively decreased towards the club face 2. These are also applied to the heel front region A1. In this case, the crown portion and/or sole portion can be provided with the zone (L2, L3). But, in view of the rebound characteristic, it is preferable that neither is provided with such zone, not to reduce the club face height.

In the example shown in FIGS. 8 and 9, in the cross section shown in FIG. 9 of the club head 1 in the standard state, with respect to the contour of the head, the length of the zone L2 is 30 to 60 mm along the outer surface of the front region A2 of the crown portion 4, and the radius Rc of curvature of the outer surface is not less than 3 mm, preferably more than 5 mm, but not more than 100 mm, preferably less than 75 mm. The radius Rc is progressively decreased towards the club face 2.

In the example shown in FIGS. 10 and 11, in the cross section shown in FIG. 11 of the club head 1 in the standard state, the length of the zone L3 is 30 to 60 mm along the outer surface of the front region A3 of the sole portion 5, and the radius Rs of curvature of the outer surface is not less than 3 mm, preferably more than 5 mm, but not more than 100 mm, preferably less than 75 mm. The radius Rs is progressively decreased towards the club face 2.

According to the above constructions, a large weight margin can be acquired, and the weight margin is utilized to increase the thickness in the crown portion 4, sole portion 5 and/or side portion 6 and/or to add a separate weight member larger in the specific gravity than the head main body 1A.

For the weight member, materials having a specific gravity of not less than 7.5 can be suitably used. Specifically, it is preferable that the weight is not less than 1 grams, more preferably more than 3 grams, still more preferably more than 5 grams, but not more than 40 grams, more preferably less than 35 grams, still more preferably less than 30 grams.

Then the club head 1 is attached to a club shaft to make a wood-type golf club having a length in the range of from 45 to 48 inches.

Comparison Tests

Hollow metal wood-type heads for driver (head volume 360 cc and 460 cc, loft angle 10 degrees, hook angle 4 degrees) were made and tested as follows.

The heads were, as shown in FIGS. 1-4, each composed of a hollow main body provided at the front with an opening, and a face plate fitted into the opening and welded to the main body. The main body was a casting of a titanium alloy Ti-6Al-4V. The face plate was made from the same titanium alloy through rolling. The club face area S was varied by changing the radius Rt of curvature in the side portion 6 as shown in FIG. 7.

The specifications are shown in Table 1.

weight margin:

The weights of the club heads were measured, and differences from Ref.A1, B1 are shown in Table 1.

Miss shot test:

Each head was attached to an identical FRP shaft to make a 45-inch driver, and ten testers each hit balls 20 times per a club, and the number of miss shots was counted. To determine the ball hit positions on the head, a pressure-sensitive paper was applied to the club face (the paper was replaced every 5 time hitting), and the number of shots of which impact marks were wholly or partially outside the club face was counted. In order to minimize the influence of the testers' ability, the ten testers were grouped into a first group of five golfers whose handicap ranged from 30 to 40, and a second group of five golfers whose handicap ranged from 10 to 20.

The test results are shown in Table 1.

Durability Test:

Each club was mounted on a swing robot. Then, at the head speed of 51 meter/second, the head hit two-piece golf balls 3000 times. After such 3000-time hitting test, the face portion and the junction of the face plate and head main body were checked. The results are shown in Table 1, wherein "A" means that no damage was found, and "B" means that damage was found.

TABLE 1

| | Ref. A1 | Ref. A2 | Ex. A1 | Ex. A2 | Ref. A3 | Ref. B1 | Ref. B2 | Ex. B1 | Ex. B2 | Ex. B3 | Ref. B3 |
|---|---|---|---|---|---|---|---|---|---|---|---|
| Head | | | | | | | | | | | |
| Head volume V (cc) | 360 | 360 | 360 | 360 | 360 | 460 | 460 | 460 | 460 | 460 | 460 |
| Club face area S (sq · cm) | 35 | 35 | 33 | 31 | 28 | 43 | 43 | 41 | 35 | 31 | 28 |
| (S − 0.08 * V) | 6.2 | 6.2 | 4.2 | 2.2 | −0.8 | 6.2 | 6.2 | 4.2 | −1.8 | −5.8 | −8.8 |
| Overall club head weight G (g) | 159 | 151 | 156 | 154 | 150 | 186 | 177 | 183 | 175 | 170 | 166 |
| Face portion weight g (g) | 46 | 38 | 43 | 41 | 37 | 57 | 48 | 54 | 46 | 41 | 37 |
| (g/G) × 100(%) | 29 | 25 | 28 | 27 | 25 | 31 | 27 | 30 | 26 | 24 | 22 |
| Thickness | | | | | | | | | | | |
| Face portion t (mm)* | 2.8 | 2.3 | 2.8 | 2.8 | 2.8 | 2.8 | 2.4 | 2.8 | 2.8 | 2.8 | 2.8 |
| t/S | 0.080 | 0.066 | 0.085 | 0.090 | 0.100 | 0.065 | 0.056 | 0.068 | 0.080 | 0.090 | 0.100 |
| Crown portion (mm)* | 0.8 | 0.8 | 0.8 | 0.8 | 0.8 | 0.8 | 0.8 | 0.8 | 0.8 | 0.8 | 0.8 |
| Side portion (mm)* | 0.8 | 0.8 | 0.8 | 0.8 | 0.8 | 0.8 | 0.8 | 0.8 | 0.8 | 0.8 | 0.8 |
| Sole portion (mm)* | 1.2 | 1.2 | 1.2 | 1.2 | 1.2 | 1.2 | 1.2 | 1.2 | 1.2 | 1.2 | 1.2 |
| Weight margin (g) | — | 8 | 3 | 5 | 9 | — | 9 | 3 | 11 | 16 | 20 |
| Number of miss shots | | | | | | | | | | | |
| 1st group | 2 | 3 | 5 | 9 | 12 | 1 | 1 | 2 | 2 | 10 | 16 |
| 2nd group | 0 | 0 | 1 | 2 | 4 | 0 | 1 | 0 | 0 | 3 | 5 |
| Durability | A | B | A | A | A | A | B | A | A | A | A |

*The thickness was substantially constant.

The invention claimed is:

1. A wood-type golf club head having a head volume V (cc) and comprising a hollow metal structure and a separate weight member, the hollow metal structure comprising:

a face portion of which front surface defines a club face for hitting a ball, wherein the area S (sq.cm) of the club face and the head volume V (cc) satisfy the following equations $$S \geqq (V \times 0.08) + (-5.8),$$

$$S \leqq (V \times 0.08 + (-1.8), \text{ and}$$

$$S \geqq 33, \text{ and wherein}$$

the weight of the face portion is not less than 20% but not more than 40% of the overall weight of the club head;

a crown portion intersecting the club face at the upper edge thereof;

a sole portion intersecting the club face at the lower edge thereof;

a side portion between the crown portion and sole portion which extends from a toe-side edge to a heel-side edge of the club face through a back face of the club head; and a hosel portion protruding upward from the crown portion and provided at the upper end thereof with a shaft inserting hole, wherein said hollow metal structure is composed of a head main body made of a metal material, and a face plate made of a metal material and disposed at the front of the head main body to form at least a major part of said face portion, the head main body is formed by casting and provided at the front with an opening, and the face plate is formed from a rolled titanium alloy and fitted in the opening and welded to the head main body with the edges of the face plate and the opening confronting each other and the back face of the face plate facing the hollow, whereby said major part of the face portion is composed of a single layer of the titanium alloy, said separate weight member has a larger specific gravity than the head main body and a mass of not less than 1 grams but not more than 40 grams, and wherein in a zone (L1, L2, L3) defined as extending backward from the edge of the club face for a distance in a range of from 30 to 60 mm along an outer surface of the club head, said outer surface is curved with a radius (Rt, Rc, Rs) of curvature progressively decreasing towards the club face, and said zone is provided in at least one of the crown portion, the sole portion and a toe-side part of the side portion, wherein in the case that the zone (L1) is provided in the toe-side part of the side portion, with respect to the contour of the club head in the top view of the club head, the radius (Rt) of curvature of said curved outer surface is not less than 3 mm but not more than 60 mm, in the case that the zone (L2) is provided in the crown portion, in a cross section of the club head including the center of gravity of the head and a sweet spot on the club face, the radius (Rc) of curvature is not less than 3 mm but not more than 100 mm, and in the case that the zone (L3) is provided in the sole portion, in a cross section of the club head including the sweet spot and the center of gravity, the radius (Rs) of curvature is not less than 3 mm but not more than 100 mm.

2. The wood-type golf club head according to claim 1, wherein the head volume V is not more than 500 cc.

3. The wood-type golf club head according to claim 1, wherein the weight of the face portion is 22 to 35% of the overall weight of the club head.

4. The wood-type golf club head according to claim 1, wherein the overall weight of the club head is 150 to 210 grams.

5. The wood-type golf club head according to claim 1, wherein the face portion has an average thickness t(cm) which is 0.068 to 0.090 times the area S (sq.cm) of the club face.

6. The wood-type golf club head according to claim 1, wherein the head volume V is not more than 500 cc, the overall weight of the club head is 150 to 210 grams, the weight of the face portion is not less than 22% but not more than 35% of the overall weight of the club head, the average thickness t(cm) of the face portion is 0.068 to 0.090 times the area S (sq.cm) of the club face.

7. The wood-type golf club head according to claim 1, wherein the head volume V is less than 460 cc.

8. A method for manufacturing the wood-type golf club head set forth in claim 1, comprising the steps of:

providing the head volume V (cc) in a range of from 435 to 500 cc;

providing the overall weight of the club head in a range of from 150 to 210 grams;

designing the hollow metal structure comprising producing a weight margin for the overall weight of the club head by setting the weight of the face portion in a range of from 20 to 40% of the overall weight, and setting the area S (sq.cm) of the club face: to satisfy the following equations $$S \geqq (V \times 0.08) + (-5.8),$$

$$S \leqq (V \times 0.08 + (-1.8), \text{ and}$$

$$S \geqq 33, \text{ and}$$

utilizing the weight margin to adjust the centre of gravity of the head by partially increasing the thickness of the crown portion, sole portion and/or side portion and/or by assigning to the separate weight member;

preparing the hollow metal structure by welding the face plate to the head main body;

preparing the separate weight member; and combining the hollow metal structure and the separate weight member.

* * * * *